US005343890A

United States Patent [19]

Deutch

[11] Patent Number: 5,343,890

[45] Date of Patent: Sep. 6, 1994

[54] SUMP PROTECTOR

[76] Inventor: Todd D. Deutch, 9420 N. Broadmoor Rd., Bayside, Wis. 53217

[21] Appl. No.: 98,434

[22] Filed: Jul. 28, 1993

[51] Int. Cl.[5] ..... B65D 25/00

[52] U.S. Cl. ..... 137/363; 220/218; 137/370; 417/540

[58] Field of Search ..... 417/540; 137/353, 359, 137/370; 220/216, 218, 484

[56] References Cited

U.S. PATENT DOCUMENTS 2,388,163 10/1945 Laird ..... 220/216
2,672,409 3/1954 Perkins ..... 220/216 X
4,199,074 4/1980 Gammell et al. ..... 220/218
4,378,437 3/1983 Cook ..... 220/216
5,076,762 12/1991 Lykes et al. ..... 417/360 X

*Primary Examiner*—Richard E. Gluck
*Attorney, Agent, or Firm*—Andrus, Sceales, Starke & Sawall

[57] ABSTRACT

An overflow protector for a sump having a wall defining an open top reservoir includes a stop member forming an abutment along the wall of the reservoir, a floating sleeve member movable between a non-operable position contained within the reservoir and an operable position projecting from the reservoir for increasing the storage capacity of the reservoir, and a sealing arrangement for sealing the sleeve member against the abutment when the sleeve member moves to its operable position.

10 Claims, 4 Drawing Sheets

SUMP PROTECTOR

FIELD OF THE INVENTION

This invention generally relates to overflow protection systems, and more particularly, pertains to an overflow protection system for a failed sump pump system wherein the storage capacity of the sump is temporarily modified until a resumption of the sump pump system occurs.

BACKGROUND OF THE INVENTION

It is common practice to provide a sump or reservoir in a basement floor to accumulate excess fluids such as rain or flood water. Once the water has reached the sump, it must be removed by a sump pump to an alternate location, usually outside the house or into a drain. However, if the sump pump ceases to operate due to a mechanical or power failure, nothing can be done to empty the sump unless there is expensive back-up power available, such as a generator. Without such back-up, the water will continue to rise above the level of the sump and will eventually leak out deleteriously and overflow onto the basement floor. As should be appreciated, overflow of the sump due to the failure of the sump pump can be messy and damaging to the surrounding basement premises.

Accordingly, it is especially desirable to provide overflow protection for a sump pump system which can handle the extra accumulation of water and considerably delay the time in which the water will leak out onto the basement floor, making it much less likely that overflow will occur before the sump pump is restored. It is also desirable to provide an overflow protector wherein auxiliary electrical or mechanical power is not required.

SUMMARY OF THE INVENTION

The present invention advantageously provides an improved overflow protection system having a unique arrangement for temporarily increasing the storage capacity of a sump due to the failure of a sump pump therein. The improved overflow protection system is relatively simple, affordable, and can be used as a retrofit in other existing systems as desired.

These and other advantages are realized in one aspect of the invention by an overflow protector for a sump having a wall defining an open top reservoir, and comprising a stop member forming an abutment along the wall of the reservoir, a floating sleeve member movable between a non-operable position contained within the reservoir and an operable position projecting from the reservoir for increasing the storage capacity of the reservoir, and a sealing arrangement for sealing the sleeve member against the abutment when the sleeve member moves to its operable position.

In a highly preferred embodiment, the invention contemplates a floating sleeve member telescoped within a sump, wherein the wall of the sump is provided with a plurality of support brackets normally supporting the floating sleeve member when the floating sleeve member is in a non-operable position. The bottom of the floating sleeve member is provided with a rubber seal matingly engageable with the stop member when the floating sleeve member is movable to the operable position.

The invention also envisions an overflow protection system for a sump which may be retrofit with a wall defining a reservoir used to surround the existing sump pump, which may be of any variety.

BRIEF DESCRIPTION OF THE DRAWINGS

The invention will become better understood by reference to the following detailed description of the preferred exemplary embodiment when read in conjunction with the appended drawing, wherein like numerals denote like elements and.

DETAILED DESCRIPTION OF THE PREFERRED EMBODIMENT

Figure 1:
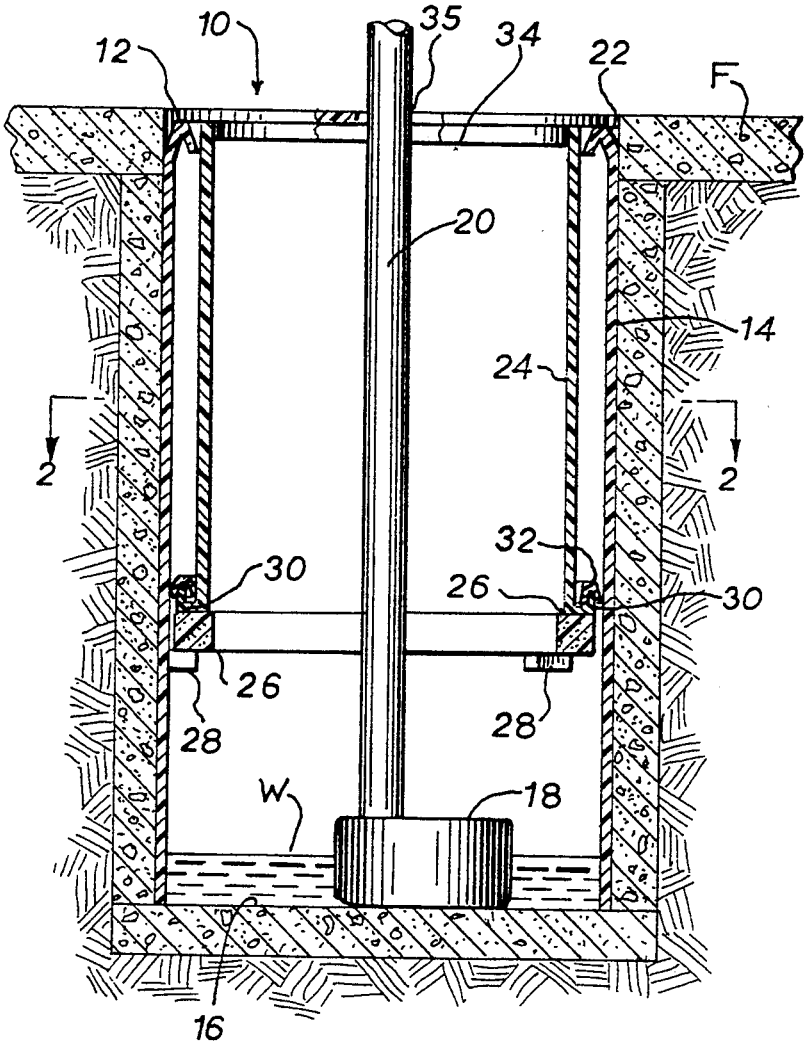
FIG. 1 is a cross sectional view of the overflow protection system embodying the present invention in a non-operable position.
Figure 2:
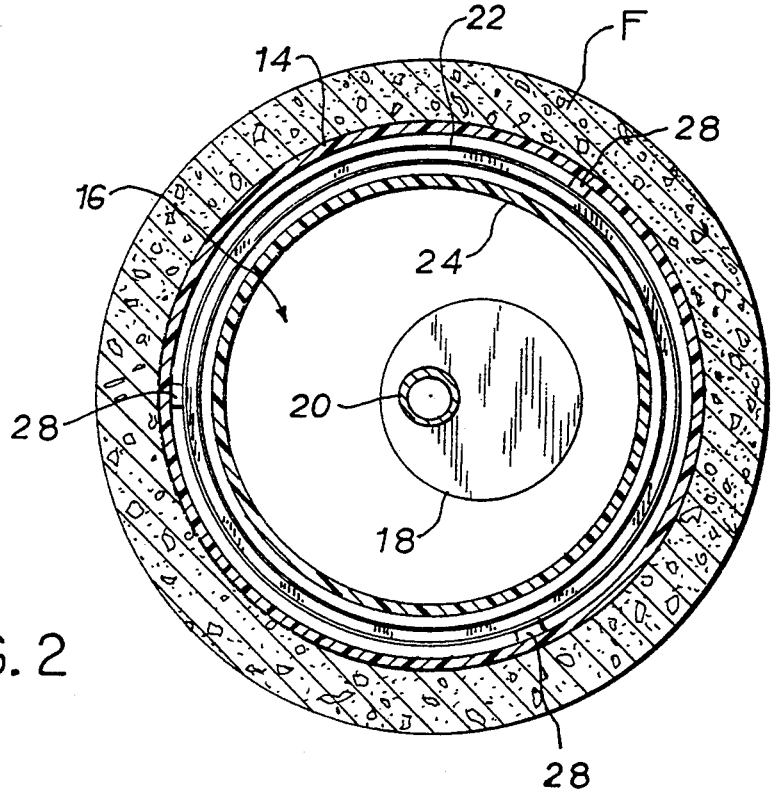
FIG. 2 is a cross sectional view taken on line 2—2 of FIG. 1.

Referring now to FIGS. 1–4, an overflow protection system 10 embodying the present invention is provided for a sump 12 formed in the basement floor F of a house. Sump 12 includes a generally cylindrical, plastic wall 14 extending throughout the depth of sump 12 and defining an open top reservoir 16 for accumulating excess rain or flood water W. Disposed at the bottom of reservoir 16 is a combination sump pump and float 18, having an output pipe 20 extending upwardly therefrom and over reservoir 16 for channeling excess water W from reservoir 16 to an alternate location (not shown) outside the house or into a drain. For purposes to be appreciated hereafter, a stop member 22 is provided along wall 14 of reservoir 16, preferably at the top thereof, in the form of a flange located adjacent and projecting inwardly towards the open top of reservoir 16.

As a salient feature of the invention, overflow protection system 10 includes a generally cylindrical, preferably plastic, floating sleeve member 24 having a buoyant base ring 26, preferably comprised of styrofoam, telescoped within reservoir 16 and normally supported in a non-operable position on a plurality of support brackets 28 extending inwardly from wall 14 of reservoir 16. As seen best in FIG. 4, the bottom of floating sleeve member 24 is formed with an outwardly turned, U-shaped terminus 30 provided with a rubber seal 32 which is frustroconical in cross section. The top of floating sleeve member 24 is provided with a cover 34, which is suitably formed with an aperture 35 through which pipe 20 passes.

Figure 3:
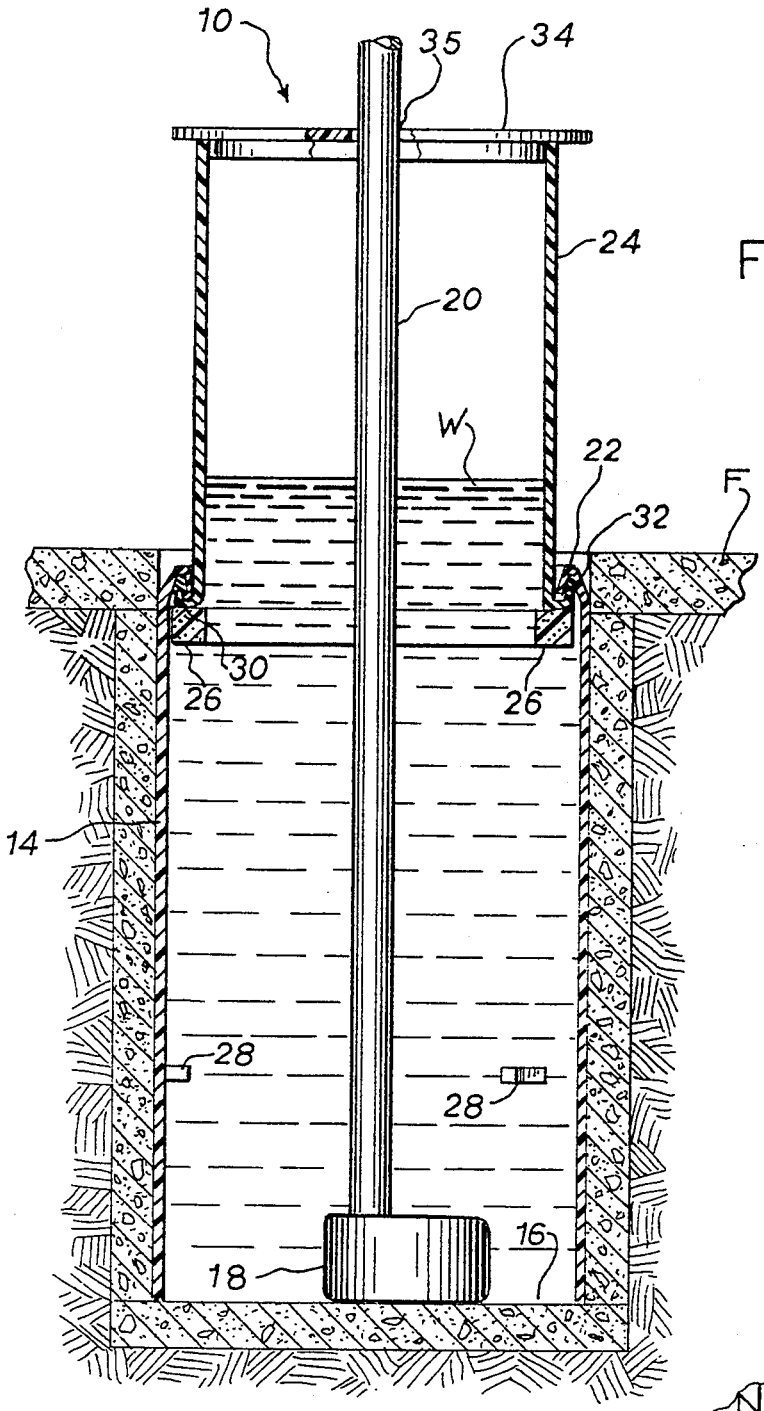
FIG. 3 is a cross sectional view similar to FIG. 1 showing the overflow protection system in an operable position wherein the storage capacity of the sump is temporarily expanded.
Figure 4:
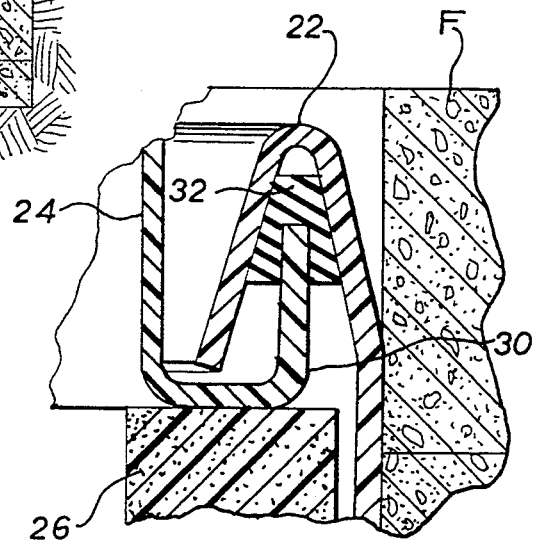
FIG. 4 is an enlarged detail view with a sealing arrangement used in the overflow protection system.

It should be understood if for any reason sump pump 18 fails, water W will begin to accumulate in sump 12, and once it reaches the level of supporting brackets 28, it will begin to move the floating sleeve member 24 upwardly from the position in FIG. 1 to the position in FIG. 3 until seal 32 matingly engages stop member 22 at the top of reservoir 16. This action effectively increases the storage capacity of sump 12, enabling reservoir 16 to retain more water W because of the sealed engagement with wall 14 of sump 12. Ideally, overflow protection system 10 will accommodate excessive water W until sump pump operation is restored, after which the falling water level will cause the floating sleeve member to sink of its own weight to occupy the space inside the wall of the sump in a telescoping fashion where it is recessed out of the way.

Figure 5:
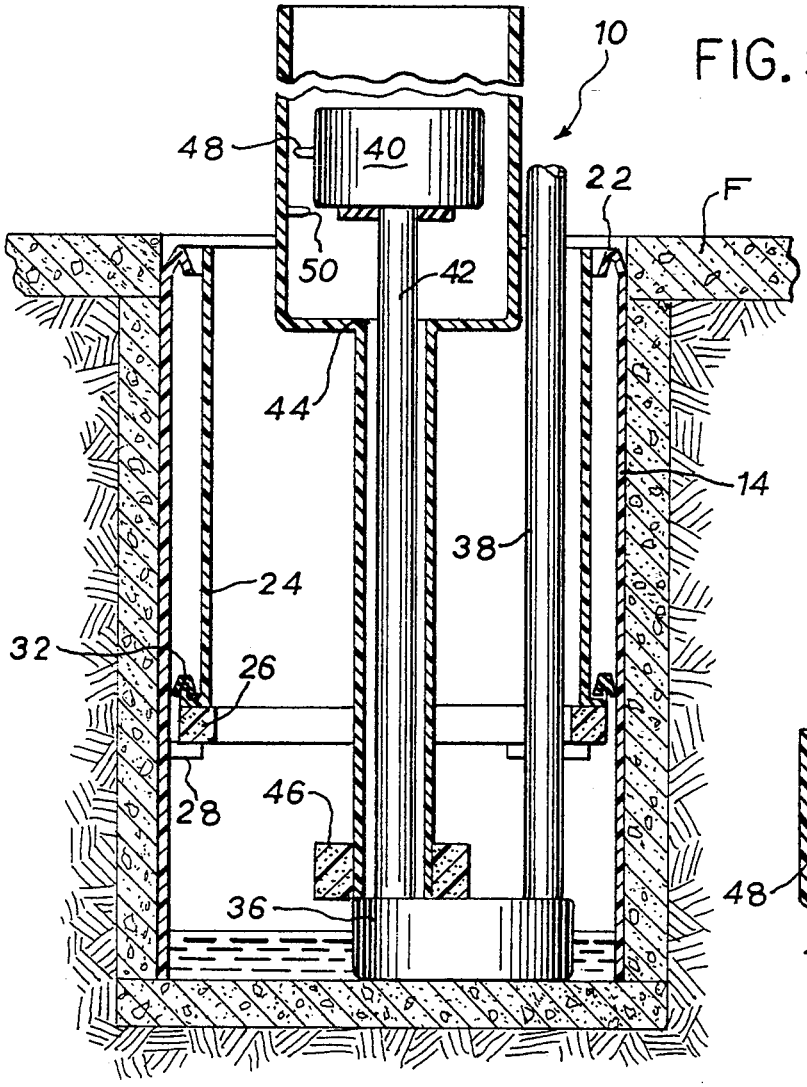
FIG. 5 is a cross sectional view of an alternate embodiment of the overflow protection system using a modified sump pump system.
Figure 6:
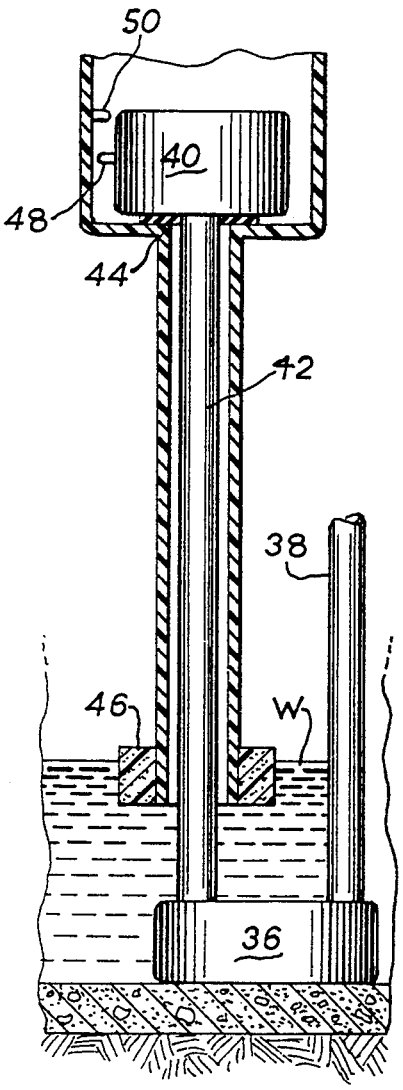
FIG. 6 is a fragmentary view of the sump pump system shown in FIG. 5 at a different position.

In the alternate embodiment shown in FIGS. 5 and 6, the sump pump arrangement is comprised of a separate pump unit 36, having an upwardly extending pipe 38 as before described, as well as a separate electric motor 40 connected by an elongated shaft 42 to pump 36. Motor 40 and its shaft 42 are enclosed in a floating jacket 44, having a buoyant styrofoam sleeve 46 at the bottom thereof resting on pump 36. Motor 40 has an on/off toggle switch 48 which is engageable with an inwardly projecting ear 50 formed on jacket 44. When water W has accumulated above the top level of pump 36, jacket 44 will rise commensurately with the water level and the upward movement thereof will cause ear 50 to engage toggle switch 48 on motor 40, so as to turn motor 40 on, so that the excess water W will be pumped from sump 12 as before. Again, if for any reason this sump pump arrangement should fail, floating sleeve member 24 and sealing arrangement 22, 32, as above described, will come into play.

Figure 7:
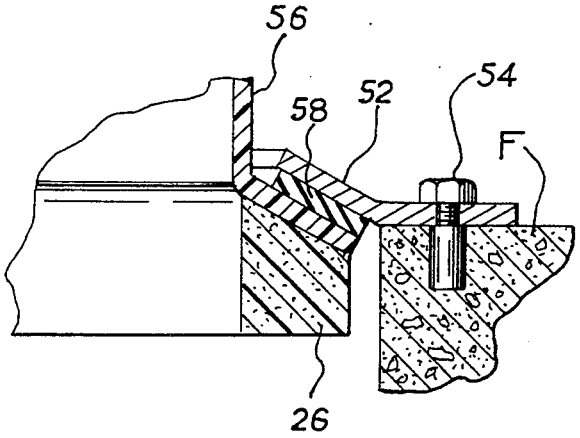
FIG. 7 is an enlarged detail view of an alternate sealing arrangement used in the overflow protection system.
Figure 8:
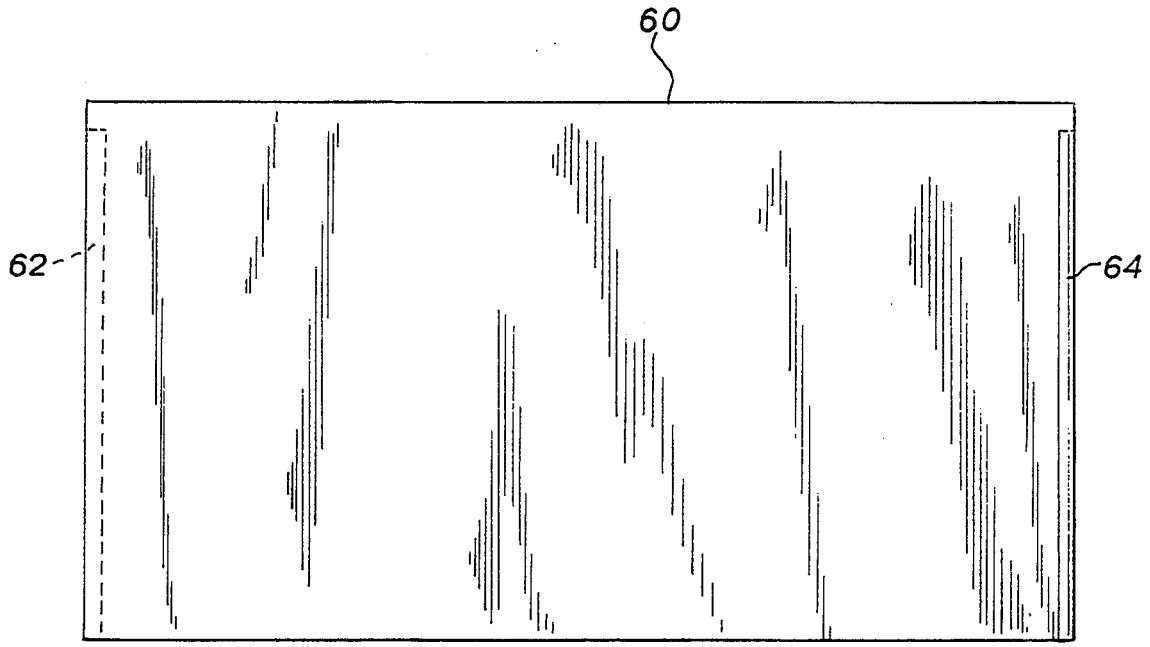
FIGS. 8—10 show a retrofit wall which may be used in the overflow protection system over the invention.
Figure 9:
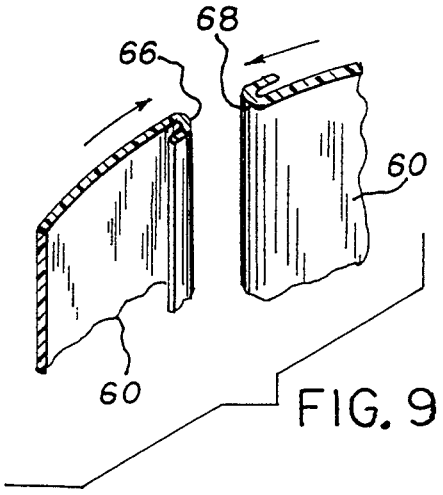
Figure 10:
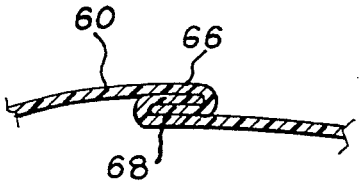

FIG. 7 shows an alternate sealing arrangement wherein a plate 52 is joined by a fastener 54 around the top of reservoir 16 and cooperates with the bottom of the floating sleeve member 56, which is shaped in a bent L and carries a complementary rubber seal 58, which again is matingly engageable with plate 52 when floating sleeve member 56 is moved to an operable position.

In the event it is desired to retrofit overflow protection system 10 on an existing sump pump arrangement, a one-piece, flexible plastic sheet 60 having cooperating opposed edges 62, 64 formed with interlocking flanges 66, 68 to define a cylinder, is adapted to be inserted into sump 12.

It should be recognized that the present invention enhances the versatility of an overflow protection system and offers a further dimension in establishing overflow protection without undue cost. In providing the latter, an increased reservoir storage capacity is quickly, easily and clearly established for a dweller, without providing expensive additional back-up power.

While the invention has been described with reference to a preferred embodiment, those skilled in the art will appreciate that certain substitutions, alterations and omissions may be made without departing from the spirit thereof. For example, while the preferred form of the invention focuses upon an inwardly turned flange at the top of the open top reservoir, it should be apparent that a flange could be provided extending outwardly from the wall of the reservoir, which could snappingly engage the sealing arrangement described. Also, it should be understood that the invention may be used as an overflow protection for an above-ground reservoir. Accordingly, the foregoing description is meant to be exemplary only, and should not be deemed limitative on the scope of the invention set forth with the following claims.

I claim:

1. An overflow protector for a sump having a wall defining an open top reservoir comprising:

a stop member forming an abutment along the wall of said reservoir;

a floating sleeve member movable between a retracted position contained within said reservoir and an extended position projecting from said reservoir for increasing the storage capacity of said reservoir;

sealing means for sealing the sleeve member against said abutment when said sleeve member moves to its extended position; and the bottom of said floating sleeve member is provided with a rubber seal matingly engageable with said stop member when said floating sleeve member is movable to the extended position.

2. The overflow protector of claim 1, wherein said stop member comprises a flange projecting into said reservoir.

3. The overflow protector of claim 2, wherein said flange is located adjacent the open top of said reservoir.

4. The overflow protector of claim 1, wherein said floating sleeve member includes a buoyant base ring.

5. The overflow protector of claim 1, wherein said wall is provided with a plurality of support brackets normally supporting said floating sleeve member when said floating sleeve member is in a retracted position.

6. The overflow protector of claim 1, including a sump pump disposed at the bottom of said reservoir.

7. The overflow protector of claim 1, wherein said reservoir includes an outlet pipe extending from the bottom of said reservoir beyond the open top of said reservoir.

8. The overflow protection of claim 1, wherein said wall is comprised of a one-piece, cylindrical plastic member.

9. The overflow protector of claim 1, wherein said wall is comprised of a one-piece, flexible plastic sheet having cooperating opposed edges formed with interlocking flanges to define a cylinder adapted to be mounted in said sump.

10. The overflow protector of claim 1, wherein said floating sleeve member includes a cover disposed at the upper end thereof.

* * * * *